United States Patent [19]

Hatz et al.

[11] 4,141,334

[45] Feb. 27, 1979

[54] SOUND-PROOFED INTERNAL COMBUSTION ENGINE

[75] Inventors: Ernst Hatz; Erich Absenger, both of Ruhstorf, Fed. Rep. of Germany

[73] Assignee: Motorenfabrik Hatz GmbH & Co. KG, Ruhstorf, Fed. Rep. of Germany

[21] Appl. No.: 817,893

[22] Filed: Jul. 21, 1977

[30] Foreign Application Priority Data

Jul. 30, 1976 [DE] Fed. Rep. of Germany ..... 2634203

[51] Int. Cl.[2] ..... F02B 77/00; F01P 1/02

[52] U.S. Cl. ..... 123/198 E; 123/41.7; 181/204

[58] Field of Search ..... 123/198 E, 195 C, 195 S, 123/41.7, 41.79; 181/204

[56] References Cited

U.S. PATENT DOCUMENTS

| | | | |
|---|---|---|---|
| 1,922,200 | 8/1933 | Frank | 123/198 E |
| 2,086,036 | 7/1937 | Juergens | 123/198 E |
| 2,177,687 | 10/1939 | Bracken et al. | 123/198 E |
| 3,774,710 | 11/1973 | Gustausson | 123/198 E X |
| 3,924,597 | 12/1975 | Hatz et al. | 123/198 E |
| 3,949,726 | 4/1976 | List | 123/198 E |
| 3,951,114 | 4/1976 | Fachbach | 123/198 E X |
| 3,964,462 | 6/1976 | Thien et al. | 123/198 E |
| 4,071,009 | 1/1978 | Kraina | 123/198 E |

FOREIGN PATENT DOCUMENTS

| | | | |
|---|---|---|---|
| 1249585 | 9/1967 | Fed. Rep. of Germany | 123/198 E |

*Primary Examiner*—Ira S. Lazarus

*Attorney, Agent, or Firm*—Blanchard, Flynn, Thiel, Boutell & Tanis

[57] ABSTRACT

A sound absorbing arrangement for an internal combustion engine having sound absorbing panels encasing the internal combustion engine. Cooling air is drawn in through openings in the paneling to subject the external surface of the engine body to the cooling air. The panels are lined with a sound absorbing material. The sound emitted from the air filter is muffled by arranging the air intake thereto so that it passes first in and around the engine and then through an intake pipe from the chamber defined by the paneling into the air filter.

5 Claims, 4 Drawing Figures

SOUND-PROOFED INTERNAL COMBUSTION ENGINE

FIELD OF THE INVENTION

The invention relates to an internal combustion engine having a casing which fully surrounds the engine body for the purpose of providing sound-absorption and includes an air cooling blower which draws in the cooling air through an elongated, multiply curved inlet channel lined with sound-absorbing layers and extends preferably above the engine body and over the entire length of the same, wherein the cooling air after passing through the casing of the engine body exits to the outside through an also elongated outlet channel lined with sound-absorbing layers.

BACKGROUND OF THE INVENTION

The purpose of the present invention is to increase the efficiency of the sound absorption of the engine over the known constructions by considerably reducing the air intake noise at the air filter compared with comparable types of structures. This purpose is inventively attained by the air filter having a separate flat ring housing for the combustion air and being arranged within the inlet channel and by the air inlet into the ring housing of the air filter taking place through a funnellike pipe which extends preferably parallel to the cylinder axis into the inside of the casing. In this manner, the sound oscillations which start out from the air filter encounter prior to their exit from the engine casing many obstacles and passageways which reduce the noise level, such as multiple deflections and reflections, and passage thereof through chambers of differing volumes, which chambers lie one behind the other, passages and narrow points and furthermore double wall construction for the guide channels at exposed points and over as much as possible long extents.

A multiple deflection and reflection of the sound waves which start out from the intake port to the air filter is achieved in a very advantageous manner by surrounding the funnellike pipe to the air filter at its port with a depressionlike shielding member. This shielding member is designed according to a different characteristic of the invention as a semi-round sheet-metal part, which is secured on the crankshaft housing and is open toward the adjacent wall of the casing.

It is furthermore very advantageous if the length of the funnellipe pipe is a multiple of its inside diameter.

BRIEF DESCRIPTION OF THE DRAWING

The following description discusses in more detail one exemplary embodiment of the invention with reference to the drawing, in which.

DETAILED DESCRIPTION

Figure 2:
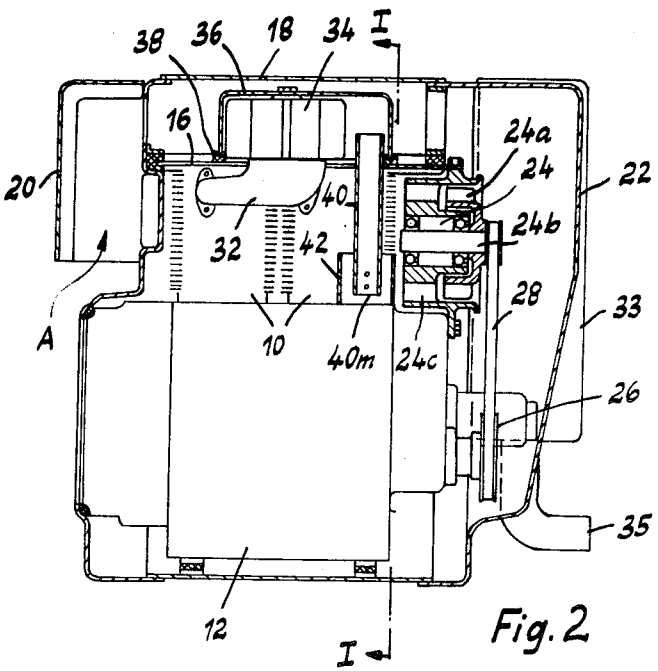
FIG. 2 is a longitudinal cross-sectional view of the casing.
Figure 1:
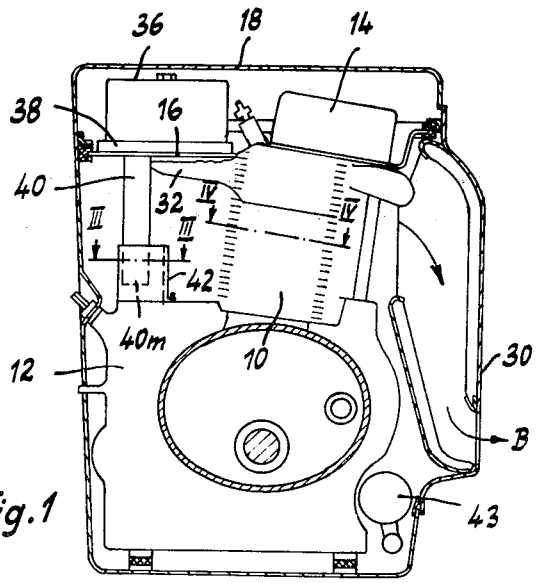
FIG. 1 is a cross-sectional view taken along the line I—I in FIG. 2 of an internal combustion engine having a casing.

The internal combustion engine which is illustrated as the exemplary embodiment is a two-cylinder fuel injection internal combustion engine having almost vertically standing cylinder housings 10 secured to the crankcase housing 12. A support plate 16 is inserted between the cylinder heads 14 and the cylinder housing 10 and on which support plate is releasably mounted the individual elements of the engine casing which extends downwardly, as discussed in detail for example in U.S. Pat. No. 3,924,597. A sound absorbing shell 18 is mounted above the machine and is also releasably secured to the support plate 16. A profiled plate 20 is attached to the shell and forms a downwardly opening air inlet channel (A) for cooling air. A shell-shaped baffle 22 is mounted on the remote side of the engine and receives air from the channel defining plates 16, 18, 20 and diverts same to an air cooling blower 24. The impeller **24*a* of the blower has a blower shaft 24*b* and is driven through a belt 28 by a drive pulley 26 which is positioned on the crankshaft of the engine. The cooling air which is drawn in is moved through a stationary guide wheel 24*c* by the blower against the cylinder housings 10 and further into the inside of the casing. After flowing around the encased engine body, the now hot air enters an outlet channel which is formed by a downwardly open sheet-metal casing 30** and leaves the casing through the outlet (B).

Combustion air is fed to the two cylinders in the cylinder housings 10 through an intake elbow duct 32, while the burnt gases are guided into an exhaust chamber which is provided outside of the casing, which exhaust chamber is here surrounded by a special casing 33 which is used for dampening sounds and which is discussed more in detail in U.S. Patent application Ser. No. 712,778, filed Aug. 9, 1976. The burnt gases exit from the exhaust chamber 33 to the outside through an exhaust pipe 35.

Figure 3:
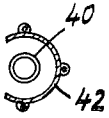
FIGS. 3 and 4 are cross-sectional views taken along the lines III—III and IV—IV, respectively, in FIG. 1.

Combustion air is fed to the intake elbow 32 from an air filter 34 which is covered by an inverted pot-shaped sheet-metal housing 36. The housing defined by the pot 36 is closed off by an annular gasket 38 which is positioned on the support plate 16 so that within the housing 36 a chamber is defined. An air-funnellike pipe 40 extends from this chamber to the inside of the engine casing. The pipe 40 is connected to the support plate 16 in a manner not illustrated in detail such that the air entrance into the inside of the housing 36 is possible only through the port **40*m* of the pipe 40. The port 40*m* is surrounded by a semicircular shielding plate 42 (FIG. 3) which is secured to the crankshaft housing 12 and is open toward the adjacent shell of the engine casing. It can clearly be seen that in the case of this arrangement, the combustion air flowing to the air filter 34 from the inside of the casing travels only through the port 40*m* of the pipe 40**.

The intake noise which occurs in the air filter 34 during operation is outwardly limited or dampened from the casing because the filter housing 36 which is exposed to the sound from the engine body is almost entirely surrounded by the sound dampening shells and this double wall construction effects a large reduction in the sound level. The still possible direct exit of noise from the engine body through the inlet or outlet openings of the casing (at 20 or 30) is subjected also to an additional amount of dampening which results from the many deflections of the sound waves and furthermore is based on the action of sound-absorbing rock wool layers within the guide channels which extend from the filter housing 36 to the mentioned openings.

The noise from the air filter 34, which during the intake function is also created and which is transmitted through air vibrations, is subjected to a first reduction in volume in the housing 36 itself. A further reduction occurs through the deflection through the pipe 40 and through the considerable length of this pipe. Finally a further reduction results from the connection of the two air volumes in the filter housing 36 and within the engine casing through the narrow pipe 40, through which these air spaces can swing to one another (interference phenomenon).

The oscillations which then still occur at the port 40*m* of the pipe 40 and are already much reduced in the above discussed manner can exit from the engine casing mostly only on the following main passageways:

1. Route (first passageway)

1.1 Flowing through the narrow gap between crankshaft housing 12 and casing, wherein multiple deflections at approximately 90° occur.
1.2 Flowing through the inbetween connected large space for the starter 43.
1.3 Deflecting into the outlet channel 30 and multiple deflection within said long channel, which is furthermore coated with sound-absorbing rock wool layers.

2. Route (second passageway)

Figure 4:
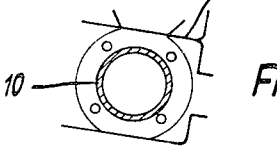

2.1 Passing through the narrow cooling ribs of the cylinder housings 10.
2.2 Multiple deflection through the cylinder encasing pieces 44 which are illustrated in FIG. 4 and are, if desired, inserted.
2.3 Deflection into the outlet channel 30 and multiple deflections within said channel, which is designed in the discussed manner.

3. Route (third passageway)

3.1 Passing through the blower 24, 24*a*, 24*c*.
3.2 Multiple deflections on the opposite shell 22.
3.3 Passing through below the encasing plate 20.
3.5 Passing through the inlet channel A, which is coated with sound-absorbing rock wool layers.

It can clearly be seen that the sound waves which exit at the port 40*m* of the pipe 40 are subjected to a plurality of obstacles on these three main routes which lead to the outside of the casing, which obstacles cause a considerable dampening of the long-wave length, low frequency intake oscillations because many of the deflections and reflections include surfaces having sound-absorbing layers and different sized chambers which are connected one behind the other (interference phenomena) and finally narrow passages or blower grills.

In this manner, the inventive arrangement of the air inlet to the filter dampens the intake noise very much and in such a manner that, together with the engine casing, a sound dampening device is obtained, which at a minimum structural expense achieves a total efficiency fully meeting the set requirements.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination with an internal combustion engine having a casing which is spaced from and fully surrounds the engine body for the purpose of providing sound absorption, an air cooling blower which draws into said spacing between said casing and said engine body cooling air through an elongated, multiply curved inlet channel means which is lined with sound-absorbing layers, an elongated outlet channel means on said casing through which the cooling air exits to the outside after passing through said spacing between said casing and said engine body, said elongated outlet channel means being lined with sound-absorbing layers, a filter housing means arranged within and being separate from said inlet channel means and housing an air filter element therein, said filter housing means including an elongated air inlet means into said filter housing means and extending into said spacing between said casing and said engine body.

2. The combination according to claim 1, wherein said air inlet means is defined by a pipe extending parallel to an axis of a cylinder on said internal combustion engine and is surrounded at its port by a shielding member.

3. The combination according to claim 1, wherein said air inlet means is defined by a pipe having a length which is a multiple of its inside diameter.

4. The combination according to claim 2, wherein said shielding member is constructed as a semi-round sheet-metal part, is secured to said engine body and is open toward the adjacent wall of the casing.

5. The combination according to claim 1, wherein said inlet channel means extends above said engine body and above the entire length thereof.

* * * * *